United States Patent [19]

McNicholas et al.

[11] Patent Number: 4,911,670

[45] Date of Patent: Mar. 27, 1990

[54] EDUCATIONAL DOLL KIT

[76] Inventors: Cindy D. McNicholas, H.C. 60, Box 119, Checotah, Okla. 74426; Melinda M. Medsker, 10 Leslie Cir., Little Rock, Ark. 72205

[21] Appl. No.: 310,667

[22] Filed: Feb. 15, 1989

[51] Int. Cl.[4] ..... A63H 3/00; A63H 3/08; A63H 33/00; G09B 25/00

[52] U.S. Cl. ..... 446/74; 446/98; 446/487; 434/429

[58] Field of Search ..... 446/74, 73, 72, 71, 446/75, 76, 82, 85, 97, 98, 99, 100, 101, 387, 478, 901, 487; 273/DIG. 30; 434/429, 430

[56] References Cited

U.S. PATENT DOCUMENTS

| | | | |
|---|---|---|---|
| 1,330,089 | 2/1920 | Plauché | 446/73 X |
| 1,405,134 | 1/1922 | Hoyme | 446/73 X |
| 1,600,554 | 9/1926 | Marquis | 446/75 |
| 2,642,697 | 6/1953 | Haskell | 446/98 |
| 3,051,959 | 9/1962 | Baws | 446/98 X |
| 3,316,669 | 5/1967 | Nachbar | 446/98 X |
| 3,414,987 | 12/1968 | Lindenauer | 434/429 |
| 3,458,189 | 7/1969 | Holt | 446/85 X |
| 3,471,962 | 10/1969 | Klein | 446/97 |
| 3,753,312 | 8/1973 | Hughes, Jr. | 446/387 |
| 4,372,077 | 2/1983 | Balbuena | 446/73 |
| 4,403,000 | 9/1983 | Gates | 434/430 X |
| 4,696,652 | 9/1987 | Reeder et al. | 446/75 |
| 4,743,215 | 5/1988 | Emmons | 446/478 |
| 4,764,142 | 8/1988 | Griffith et al. | 446/82 |

FOREIGN PATENT DOCUMENTS

| | | | |
|---|---|---|---|
| 3101074 | 7/1982 | Fed. Rep. of Germany | 446/85 |
| 2029936 | 10/1970 | France | 446/901 |
| 444755 | 3/1936 | United Kingdom | 446/71 |
| 649404 | 1/1951 | United Kingdom | 446/98 |

*Primary Examiner*—Robert A. Hafer
*Assistant Examiner*—D. Neal Muir
*Attorney, Agent, or Firm*—Richard C. Litman

[57] ABSTRACT

An educational doll kit is provided including a flat doll body to which doll clothing is removably attachable by means of hook-and-loop fasteners. One component of the fasteners is permanently affixed to the doll body and formulated to simulate undergarments, making the act of dressing the doll more realistic and ensuring that the fastener will not be exposed to view when a garment is properly applied. The kit includes a mounting board on which an environmental setting may be depicted and which can be refined by the application of scenic components, likewise removably attachable by means of hook-and-loop fasteners. Both the articles of clothing and the scenic components are of an improved construction enabling them to more closely simulate, respectively, actual clothing and envionrmental objects. The doll kit can provide an educational experience to children, teaching them the type of clothing which would be appropriate for a selected environmental setting.

13 Claims, 3 Drawing Sheets

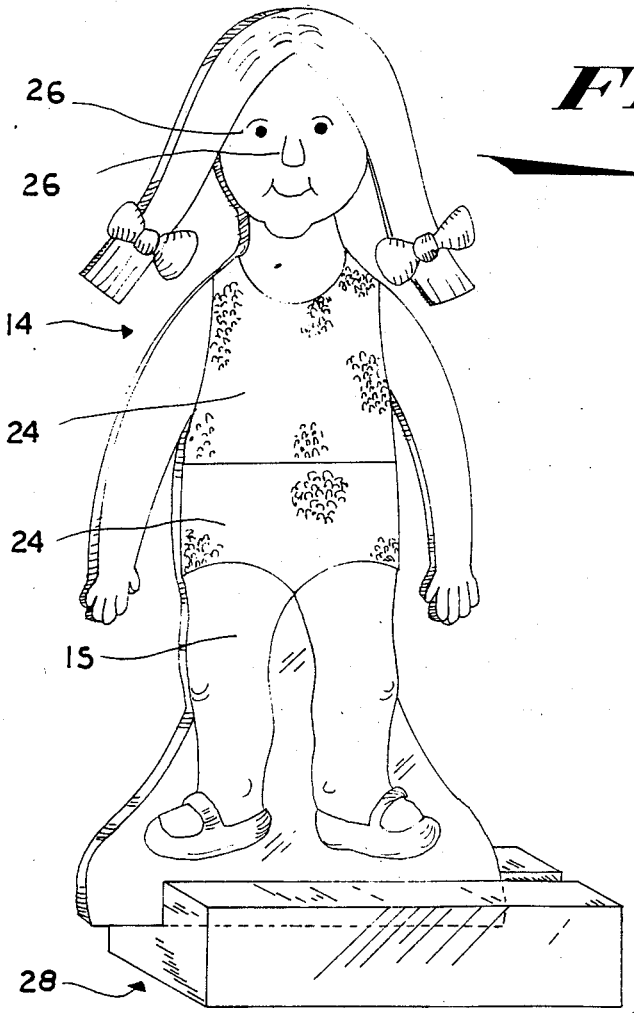
FIG. 3
FIG. 4
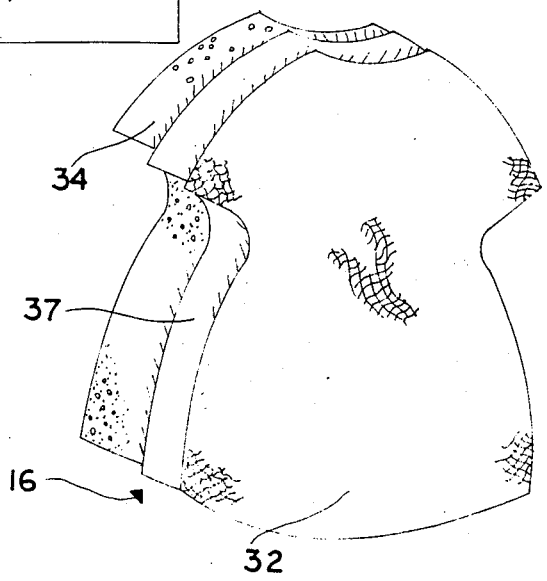

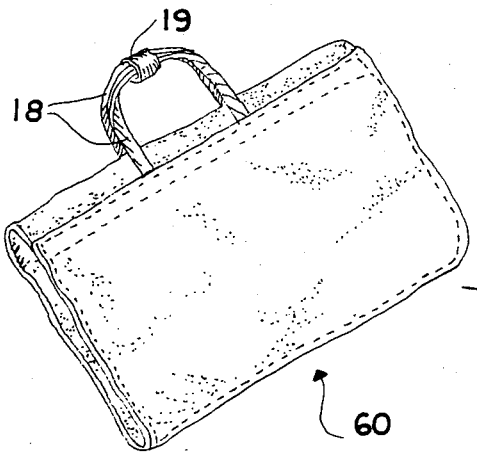
FIG. 2A
FIG. 5
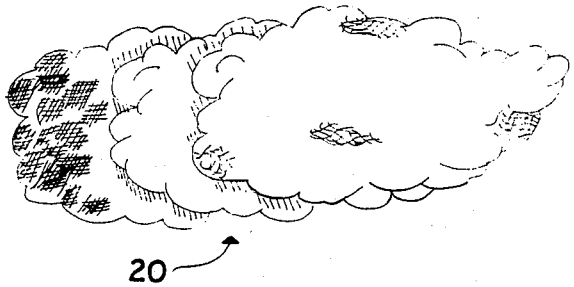
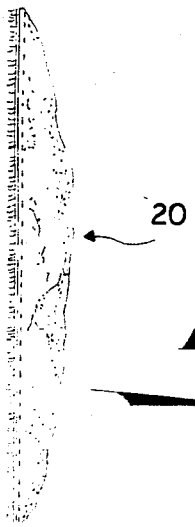
FIG. 5A

EDUCATIONAL DOLL KIT

BACKGROUND OF THE INVENTION

1. FIELD OF THE INVENTION

The invention relates to a doll kit comprising dolls and doll clothing ensembles and more particularly, the invention is directed to an improved doll and doll clothing ensemble with improved fastening means for securing the clothing to the doll body.

The invention further relates to an improved doll kit comprising a backdrop adapted to simulate an environmental setting which may serve as an educational tool for children. More particularly, the invention is directed to teaching a child the type of clothing which would be appropriate for a particular environment while providing entertainment. The doll kit is also used for teaching the cultural habits and customs of a particular ethnic group in a particular environment.

2. DESCRIPTION OF THE PRIOR ART

Dolls having flat bodies to which articles of doll clothing may be attached are well known in the prior art. Representative of such dolls are the devices disclosed in the following patents:

| U.S. Patent No. | Inventor |
|---|---|
| 2,093,207 | Munson |
| 2,331,776 | Heggedal |
| 3,753,312 | Hughes, Jr. |

U.S. Pat. No. 2,093,207 discloses a doll comprising a flat doll body having a fuzzy forward surface, such as suede paper, to which articles of clothing having a roughened rear surface, such as wool or felt, frictionally adhere.

U.S. Pat. No. 2,331,776 discloses a toy including a flat body in the form of a doll, house, etc., having strips of oil cloth secured to its forward surface. Articles such as doll clothing having a rear surface comprising oil cloth adhere to the strips on the flat body.

U.S. Pat. No. 3,753,312 discloses a flat doll body having a plastic forward surface to which doll clothing having a tacky vinyl rear surface removably adheres.

Each of these prior art devices discloses a doll and clothing ensemble including a flat doll body to which doll clothing adheres. However, each has the disadvantage that the bond between the clothing and the doll body is not very strong, with the result that the clothing may unintentionally become separated from the doll body when the doll is tipped forward or otherwise manipulated, and may consequently become misplaced.

Furthermore, none of these prior art devices discloses a backdrop simulating a selected environmental setting to which a particular type of dress would be appropriate, and to which scenic components simulating environmental objects can be removably secured.

SUMMARY OF THE INVENTION

It is a general object of the present invention to provide a doll having improved means by which the doll clothing is fastened to the doll body.

It is another general object of the present invention to provide a backdrop for such a doll which simulates an environmental setting to which a particular type of clothing would be appropriate.

It is a more particular object of the present invention to provide a doll having a substantially flat body to which articles of doll clothing may be removably secured by means of mating hook-and-loop fasteners.

It is a further object of the present invention to provide an improved doll having fastening strips permanently affixed to the frontal surface of the doll body and which simulate undergarments, whereby the act of applying an article of doll clothing more genuinely represents the act of dressing and whereby an article of doll clothing when properly applied will completely cover the fastening strips, thereby indicating appropriate dressing of the doll.

It is a further object of the present invention to provide a flat doll body having a frontal surface adapted to receive markings representing facial features or other characteristics.

It is still another object of the present invention to provide a dressable doll having doll clothing comprising plural layers of material giving it a fullness and curvature characteristic of actual clothing.

It is another object of the present invention to provide, in combination with such a doll, a freestanding backdrop having a substantially flat forward surface having a chosen environmental setting depicted thereon and cooperating with plural scenic components representing environmental objects which can be removably mounted to the forward surface of the backdrop by means of hook-and-loop fasteners. The backdrop may serve as an educational tool for teaching children the type of clothing appropriate for a selected environmental setting.

According to the present invention, there is provided a substantially flat doll body having strips of fastening material consisting of a mating component of hook-and-loop fasteners permanently affixed to its frontal surface. These strips of fastening material are located within areas of the doll body where undergarments are worn, and preferably are formulated into a size and shape to simulate actual undergarments. Plural articles of clothing are provided having an inner layer comprising cooperating fastening material. When any article of clothing is properly applied to the doll body, no part of the fastening strips on the doll body will be exposed. Furthermore, the clothing will remain affixed to the doll body even when the doll is turned upside-down or otherwise manipulated.

In a preferred embodiment, a free-standing backdrop is provided having a forward surface on which can be depicted an environmental setting and which comprises a layer of fastening material consisting of a mating component of a hook-and-loop fastener. Plural articles representing environmental objects such as the sun, clouds, furniture, etc. are removably affixable thereto by means of an inner layer of cooperating fastening material. Plural scenic components may be provided, each representing a different environmental setting to which a different type of dress would be appropriate. Preferably, one of the layers of fastening material employed in connection with the clothing comprises form material having one surface consisting of the loop component of hook-and-loop fasteners.

BRIEF DESCRIPTION OF THE DRAWINGS

FIG. 2A is a perspective view of the doll kit illustrating a folded arrangement of the present invention.

FIG. 3 is a perspective view of a doll body of the present invention with stand.

FIG. 4 is an exploded view of the construction of an article of doll clothing according to a preferred embodiment of the present invention.

FIG. 5 is an exploded view of one of the scenic components of the present invention.

FIG. 5A is a side view of one of the scenic components of the present invention.

DESCRIPTION OF THE PREFERRED EMBODIMENT

Figure 1A:
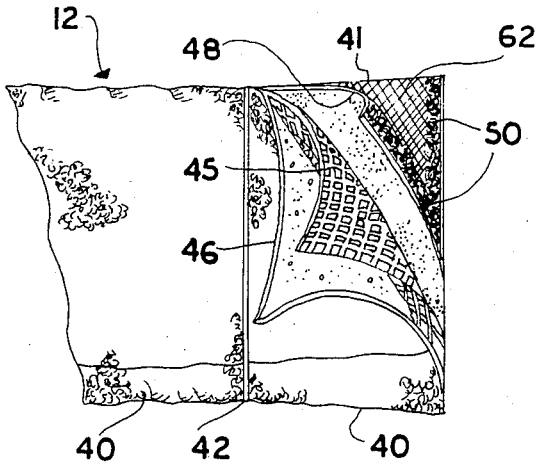
FIG. 1A is a fragmentary view of the backdrop illustrating a typical construction of a panel shown in FIG. 1.
Figure 1:
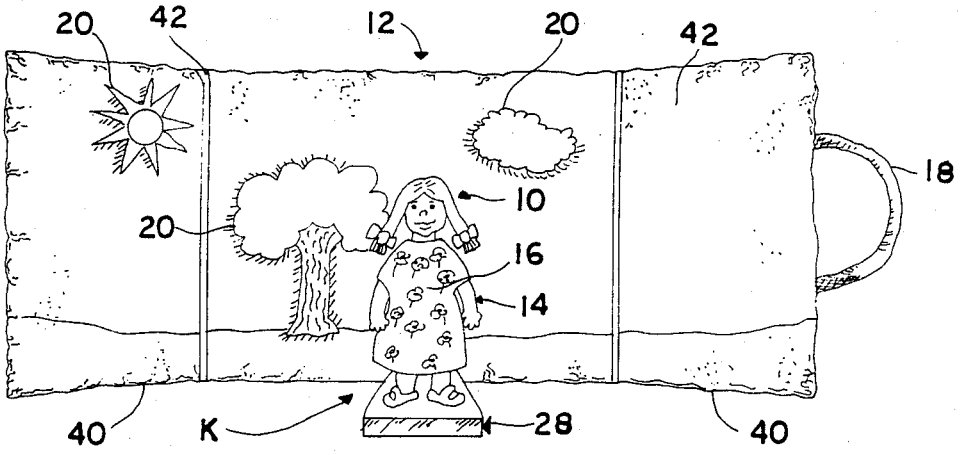
FIG. 1 is a perspective view of the doll kit illustrating a typical arrangement of the doll accessories according to a preferred embodiment of the present invention.

Turning now to the drawings, FIG. 1 is a perspective view of the doll kit K, including doll 10 and backdrop 12. Doll 10 comprises a substantially planar doll body 14 and an article of clothing 16, which is removably affixed to doll body 14 by means which will be hereinafter described. Backdrop 12 serves as a mounting board on which scenic components 20 may be affixed thereto by means similar to those by which one or more articles of clothing 16 are affixed to doll body 14. Backdrop 12 simulates an environmental setting to which articles of clothing 16 would be appropriate. As can be seen, the arrangement can serve to teach children the type of clothing appropriate to a particular environmental setting.

Turning now to FIG. 3, doll body 14 can be seen to have strips of fastening material 24 permanently affixed to its flat forward surface 15. Strips 24 comprise one component of conventional hook-and-loop fasteners and preferably the hook component. Strips 24 are permanently affixed to forward surface 15 within regions corresponding to those areas of the body where underwear are worn, and are preferably formulated to simulate undergarments. Thus, strips 24 will be completely covered when any outer garment is placed properly on doll body 14. The enhanced fastening properties of hook-and-loop fasteners makes it possible to limit the use of fastening material to strips 24.

The doll 10 can be formed from wood, plastic, synthetic rubber, or any other rigid or semi-rigid material and is adapted to include markings 26 representing features such as facial characteristics placed upon its forward surface 15. These markings 26 may be formed in a number of ways such as by drawings, etching or painting.

The doll body 14 is preferably substantially flat, although it can be of sufficient thickness to enable it to stand freely. Alternatively, doll 10 may be furnished with a removable base 28 in which doll body 14 can be inserted, enabling the doll to stand in an upright position.

As shown in FIG. 4, each article of clothing 16 is constructed of an outer layer 32 comprising cloth material and an inner layer 34 comprising cooperating fastening material adapted to cooperate with strips 24 on doll body 14. In a preferred embodiment, strips 24 comprise the hook component of hook-and-loop fasteners and inner layer 34 comprises the loop component of hook-and-loop fasteners. Alternatively, inner layer 34 may comprise any textured material, such as wool, which will cooperate with the hook component of hook-and-loop fasteners.

In a preferred embodiment, as shown in FIG. 4, article of clothing 16 comprises, in addition to outer layer 32 and inner layer 34, an interfacing layer 37 of backing material such as is used in collars, etc. to provide body and stiffness. The several layers may be secured together by any appropriate means, such as sewing around the edges. To stitching or simulated stitching means may be used to enhance the ornamental and realistic appearance of the clothing.

Also in a preferred embodiment, inner layer 34 may comprise foam material having one surface comprising the loop component of hook-and-loop fasteners. One such currently available material is marketed under the trade name VELCRO Velvet Loop Foam. Use of Velvet Loop Foam or similar material, together with the other layers, will provide articles of clothing 16 with a thickness and curvature around the edges giving them a three-dimensional appearance and enabling them to more closely resemble actual clothing.

As can be seen from the foregoing, since fastening strips 24 simulate actual undergarments, the act of applying doll clothing 16 to doll body 14 will more closely simulate the act of dressing. Also, when articles of clothing 16 are properly applied, fastening strips 24 will be completely covered. Furthermore, the use of hook-and-loop fasteners will ensure a secure bond between doll body 14 and doll clothing 16, thus ensuring that doll clothing 16 will not fall off when the doll is turned upside-down or otherwise manipulated.

Doll kit K may contain one or several dolls, including a girl doll, a boy doll, a mother doll, a father doll, a grandmother and grandfather doll together with various clothing ensembles. Doll kit K also includes means to simulate different environmental settings and each doll can be outfitted with clothing appropriate to a particular environmental setting.

Figure 2:
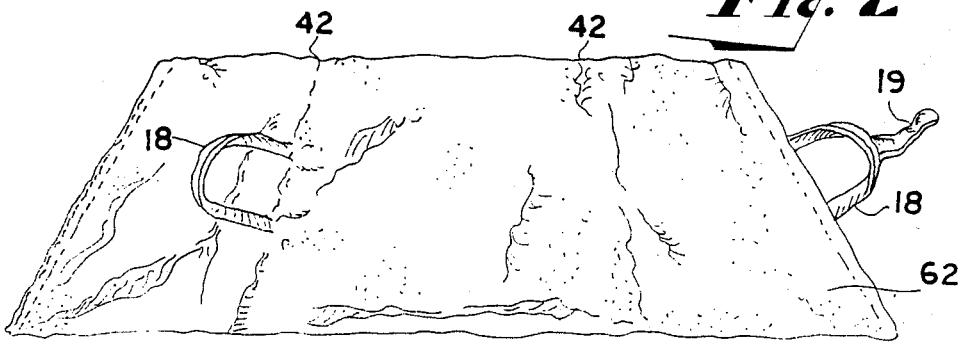
FIG. 2 is a rear view of the invention shown in FIG. 1.

Backdrop 12 can be seen in FIG. 1 to comprise multiple panels 40 connected by folds 42. As shown in FIG. 1A, panel 40 is constructed of a layer of rigid or semi-rigid base material 41 which is affixed to a durable fabric covering 62 such as nylon, as best shown in FIG. 2. Base material 41 may be made of any suitable planar material which would enable backdrop 12 to stand freely, such as cardboard, lightweight wood or plastic. Each panel 40 may be constructed of an inner layer 84 comprising fabric material, such as cotton, and an exposed layer 46 comprising cooperating fastening material adapted to cooperate with scenic components which are removably affixed thereon by means of hook-and-loop fasteners. Preferably, exposed layer 56 may comprise the VELCRO Velvet Loop Foam material discussed earlier. Between the inner layer of fabric material 48 and the exposed layer of cooperating fastening material 46 may be an intermediate layer 45 of suitable lining material, such as plastic mesh, which serves to provide body and stiffness. The several layers may be secured together by any appropriate means, such as sewing. Strips of hook-and-loop fasteners 50 are secured to base material 41 and inner layer of fabric material 48 along their respective borders in such a manner so as to fabricate a pocket when the two layers are fastened together. Pockets fabricated in this manner may serve as storage compartments in which dolls, doll clothing ensembles and various other doll kit accessories may be conveniently kept.

The exposed layer of cooperating fastening material 46 may have an environmental setting depicting thereon, which may be further refined by the use of scenic components 20 such as the cloud shown in FIG. 5. Scenic components 20 are constructed in a similar manner as doll clothing 16, with the exception that the inner surface thereof preferably comprises the hook component of hook-and-loop fasteners. An intermediate layer of suitable stuffing material may be employed to provide body to the scenic components, giving them a three-dimensional appearance as shown in FIG. 5A.

As can be seen from FIGS. 2 and 2A, the mounting board can be folded along the folds 42 into a compact case 60 provided with handles or straps 18 for easy transportation. The handles or straps 18 may be tied or wrapped together by means of cord 19 in the manner shown in FIG. 2A. Preferably, cord 19 consists of a strip of hook-and-loop fastening material sewn at one end to one of the handles or straps 18 in the manner shown in FIG. 2. Compact case 60 also provides for convenient storage of scenic components, dolls and doll accessories when the doll kit is not in use.

As can be seen from the foregoing, the backdrop forms a mounting board depicting a selected environmental setting which can then be further refined by the application of scenic components. The doll kit of the present invention thus serves as an educational device to teach children the type of clothing which would be appropriate for a chosen environmental setting.

It should be understood that various changes and modifications can be made of the disclosure without departing from the spirit and scope of the invention. Accordingly, the foregoing illustrations are not to be interpreted as restrictive of the invention beyond that necessitated by the following claims.

I claim:

1. A doll kit which may serve as an educational tool for teaching children the type of clothing which would be appropriate for a selected environmental setting comprising:

a doll having a substantially flat body including a frontal surface, said doll containing fastening strips permanently affixed to said frontal surface, said fastening strips being formulated to simulate undergarments;

a doll clothing ensemble comprising a plurality of articles of doll clothing. in which each article of doll clothing comprises an inner layer of fastening material wherein said fastening material and said fastening strips consist of cooperating components of hook-and-loop fasteners whereby said article of substantially flat clothing may be removably secured to said doll body;

a free-standing backdrop comprising multiple panels each consisting of a substantially flat forward surface having a selected environmental setting depicted thereon and containing an exposed layer of fastening material consisting of one component of a hook-and-loop fastener; and a plurality of scenic components representing environmental objects, each scenic component comprising an inner layer of a mating component of a hook-and-loop fastener wherein said scenic components are removably mounted to the forward surface of said free-standing backdrop to define one of a plurality of environmental settings to which a selected type of clothing worn by said doll would be appropriate.

2. The doll kit according to claim 1 wherein:

said article of doll clothing is constructed of an outer layer comprising cloth material, said inner layer of fastening material and an interfacing layer comprising backing material to provides body and stiffness; and the several layers of doll clothing are secured together by sewing.

3. The doll kit according to claim 2 wherein said inner layer of fastening material comprises:

a foam material having a surface consisting of a loop component of hook-and-loop fasteners to provide a three-dimensional appearance to said article of doll clothing.

4. A doll kit according to claim 1 wherein said free-standing backdrop comprises:

multiple panels connected by folds, each panel is constructed of a layer of base material affixed to a durable fabric covering, an inner layer of fabric material and said exposed layer of fastening material.

5. A doll kit according to claim 4 wherein:

said panel further includes an intermediate layer of lining material between said inner layer of fabric material and said exposed layer of fastening material; and the several layers are secured together by sewing.

6. A doll kit according to claim 4 wherein:

strips of hook-and-loop fasteners are secured to said layer of rigid of semi-rigid base material and said inner layer of fabric material along their respective borders in such a manner so as to fabricate a pocket when the layers are fastened together to provide a storage compartment in which doll kit accessories are kept.

7. A doll kit according to claim 4 wherein:

said backdrop is folded along said folds into a compact case.

8. A doll kit according to claim 7 wherein said compact case comprises:

handles or straps to provide easy transportation of said doll kit.

9. A doll kit according to claim 1 wherein:

said scenic component is constructed of an outer layer comprising cloth material;

said inner layer is constructed of a mating component of a hook-and-loop fastener and an intermediate layer comprising stuffing material to provide body; and the several layers of the scenic object are secured together by sewing around the edges.

10. A doll kit according to claim 9 wherein said scenic component exhibits a three-dimensional appearance.

11. A doll kit according to claim 1 wherein:

said doll kit includes a removable base in which said doll body is inserted.

12. A doll kit according to claim 1 wherein:

said doll includes marking representing facial characteristics painted or etched on said frontal surface.

13. A doll kit according to claim 1 wherein:

said doll body is formed from a material selected from the group consisting of cardboard, wood, plastic and synthetic rubber.

* * * * *